US011385005B1

(12) United States Patent
Garwood

(10) Patent No.: US 11,385,005 B1
(45) Date of Patent: Jul. 12, 2022

(54) FIREARM ROTOR AND METHOD OF USE

(71) Applicant: TMP Weapons, LLC, Reno, NV (US)

(72) Inventor: Tracy Warren Garwood, Reno, NV (US)

(73) Assignee: TMP Weapons, LLC, Reno, NV (US)

( * ) Notice: Subject to any disclaimer, the term of this patent is extended or adjusted under 35 U.S.C. 154(b) by 0 days.

(21) Appl. No.: 17/349,650

(22) Filed: Jun. 16, 2021

(51) Int. Cl.
*F41A 13/10* (2006.01)
*F41A 21/06* (2006.01)

(52) U.S. Cl.
CPC ..... *F41A 13/10* (2013.01); *F41A 21/06* (2013.01)

(58) Field of Classification Search
CPC ..... F41A 13/10
USPC ..... 89/14.1
See application file for complete search history.

(56) References Cited

U.S. PATENT DOCUMENTS 1,328,230 A * 1/1920 Johnston ..... F41A 9/35 89/33.03
1,527,585 A * 2/1925 Hamilton ..... F41A 13/10 89/14.1
2,365,388 A * 12/1944 Browning ..... F41A 13/12 89/14.1
3,703,122 A * 11/1972 Farrington ..... F41A 21/32 89/14.3
6,679,156 B1 * 1/2004 Danou ..... F41A 13/12 89/162
10,168,118 B2 * 1/2019 Abbott ..... F41A 21/487
2016/0091270 A1 * 3/2016 Rowe ..... F41A 21/487 89/14.05

* cited by examiner

*Primary Examiner* — Bret Hayes

(74) *Attorney, Agent, or Firm* — Procopio Cory Hargreaves and Savitch LLP

(57) ABSTRACT

A cooling rotor for a minigun that actively pulls gases and heat generated from firing the minigun comprises a front end with an axial opening; a rear end; a bore extending from the rear end to the axial opening in the front end; a plurality of longitudinally spaced, peripherally extending rotor segments; and one or more openings disposed between two or more of the plurality of longitudinally spaced, peripherally extending rotor segments whereby upon rotation of the cooling rotor gases and heat generated from firing the minigun are actively pulled through the one or more openings, the bore, and out the axial opening in the front end.

30 Claims, 5 Drawing Sheets

FIREARM ROTOR AND METHOD OF USE

FIELD OF THE INVENTION

The present invention relates to rotors for firearms.

SUMMARY OF THE INVENTION

An aspect of the invention involves a cooling rotor for a firearm (e.g., M134 minigun) that is configured to actively pull gas and heat generated from firing the firearm thru passages in the rotor and out a front of the rotor. By removing gases and debris in this manner, the rotor creates a safer environment and minimizes the possibility of flashing unspent powder. The cooling rotor is a single-piece design, minimizing misalignment from separate pieces controlling the firing of the firearm.

Another aspect of the invention involves a cooling rotor for a minigun that actively pulls gases and heat generated from firing the minigun comprising a front end with an axial opening; a rear end; a bore extending from the rear end to the axial opening in the front end; a plurality of longitudinally spaced, peripherally extending rotor segments; and one or more openings disposed between two or more of the plurality of longitudinally spaced, peripherally extending rotor segments whereby upon rotation of the cooling rotor gases and heat generated from firing the minigun are actively pulled through the one or more openings, the bore, and out the axial opening in the front end.

One or more implementations of the aspect of the invention described immediately above includes one or more of the following: one or more angled support structures between at least two of the longitudinally spaced, peripherally extending rotor segments, the one or more angled support structures including the one or more openings; the plurality of longitudinally spaced, peripherally extending rotor segments include two or more of a rotation bolt guide, a forward track, a center track, a front removable track support, a center removable track support, a rear removable track support, a front drive sleeve, and a clutch assembly support; one or more angled support structures are disposed between two or more of the rotation bolt guide, the forward track, the center track, the front removable track support, the center removable track support, the rear removable track support, the front drive sleeve, and the clutch assembly support, the one or more angled support structures including the one or more openings; the one or more angled support structures are disposed between the front removable track support and the center removable track support; the one or more angled support structures are disposed between the center removable track support and the rear removable track support; the one or more angled support structures are disposed between the front drive sleeve and the clutch assembly support; the one or more angled support structures are disposed between the front removable track support and the center removable track support, the center removable track support and the rear removable track support, and the front drive sleeve and the clutch assembly support; the one or more angled support structures are disposed extend at one or more of the same or different angles $\alpha$ from 30 degrees to 80 degrees off of the front face; and/or the rotor has a single-piece construction made of 18% nickel, cobalt strengthened steel (C-type).

An additional aspect of the invention involves a method of using a cooling rotor for a minigun that actively pulls gases and heat generated from firing the minigun comprising a front end with an axial opening; a rear end; a bore extending from the rear end to the axial opening in the front end; a plurality of longitudinally spaced, peripherally extending rotor segments; and one or more openings disposed between two or more of the plurality of longitudinally spaced, peripherally extending rotor segments whereby upon rotation of the cooling rotor gases and heat generated from firing the minigun are actively pulled through the one or more openings, the bore, and out the axial opening in the front end cooling rotor of claim of claim 1, comprising: rotating the cooling rotor; and actively pulling gases and heat generated from firing the minigun through the one or more openings, the bore, and out the axial opening in the front end, away from an operator of the minigun.

One or more implementations of the aspect of the invention described immediately above includes one or more of the following: the cooling rotor includes one or more angled support structures between at least two of the longitudinally spaced, peripherally extending rotor segments, the one or more angled support structures including the one or more openings, and actively pulling includes using the one or more angled support structures to facilitate pulling the gases and heat generated from firing the minigun through the one or more openings; the plurality of longitudinally spaced, peripherally extending rotor segments include two or more of a rotation bolt guide, a forward track, a center track, a front removable track support, a center removable track support, a rear removable track support, a front drive sleeve, and a clutch assembly support, and actively pulling includes pulling the gases and heat generated from firing the minigun through the one or more openings between two or more of the rotation bolt guide, the forward track, the center track, the front removable track support, the center removable track support, the rear removable track support, and the front drive sleeve; the cooling rotor includes one or more angled support structures disposed between two or more of the rotation bolt guide, the forward track, the center track, the front removable track support, the center removable track support, the rear removable track support, the front drive sleeve, and the clutch assembly support, the one or more angled support structures including the one or more openings, and actively pulling includes using the one or more angled support structures to facilitate pulling the gases and heat generated from firing the minigun through the one or more openings; the one or more angled support structures are disposed between the front removable track support and the center removable track support, and actively pulling includes using the one or more angled support structures to facilitate pulling the gases and heat generated from firing the minigun through the one or more openings between the front removable track support and the center removable track support; the one or more angled support structures are disposed between the center removable track support and the rear removable track support, and actively pulling includes using the one or more angled support structures to facilitate pulling the gases and heat generated from firing the minigun through the one or more openings between the center removable track support and the rear removable track support; the one or more angled support structures are disposed between the front drive sleeve and the clutch assembly support, and actively pulling includes using the one or more angled support structures to facilitate pulling the gases and heat generated from firing the minigun through the one or more openings between the front drive sleeve and the clutch assembly support; the one or more angled support structures are disposed between the front removable track support and the center removable track support, the center removable track support and the rear removable track support, and the front drive sleeve and the clutch assembly support, and actively pulling includes using the one or more angled support structures to facilitate pulling the gases and heat generated from firing the minigun through the one or more openings between the front removable track support and the center removable track support, the center removable track support and the rear removable track support, and the front drive sleeve and the clutch assembly support; the one or more angled support structures are disposed extend at one or more of the same or different angles α from 30 degrees to 80 degrees off of the front face; and/or the rotor has a single-piece construction made of 18% nickel, cobalt strengthened steel (C-type).

A further aspect of the invention involves a cooling rotor for a minigun that actively pulls gases and heat generated from firing the minigun, comprising a front end with an axial opening; a rear end; a bore extending from the rear end to the axial opening in the front end; and a plurality of longitudinally spaced, peripherally extending rotor segments

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
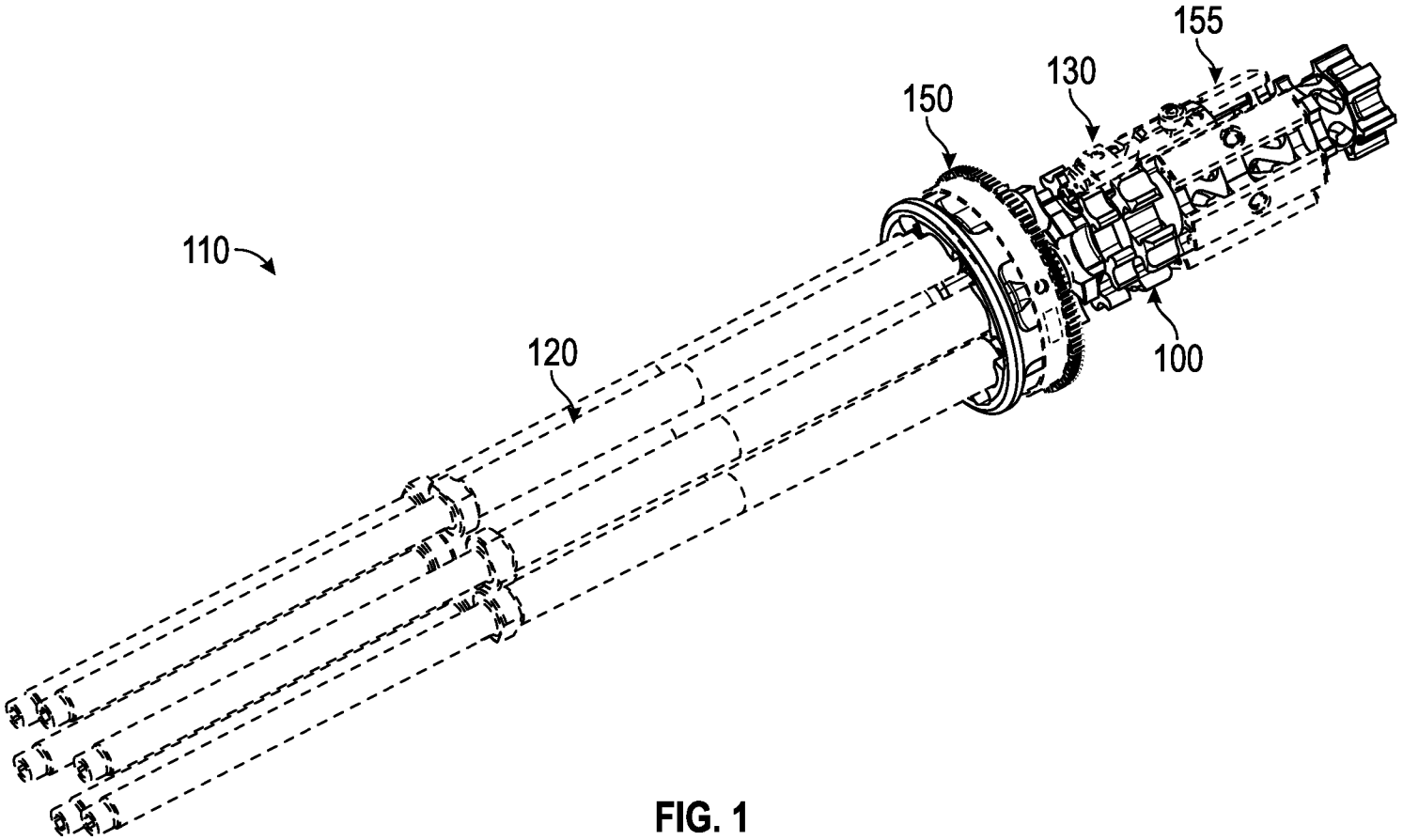
FIG. 1 is a front perspective view of a portion of a M134 machine gun including an embodiment of a cooling rotor.
Figure 2:
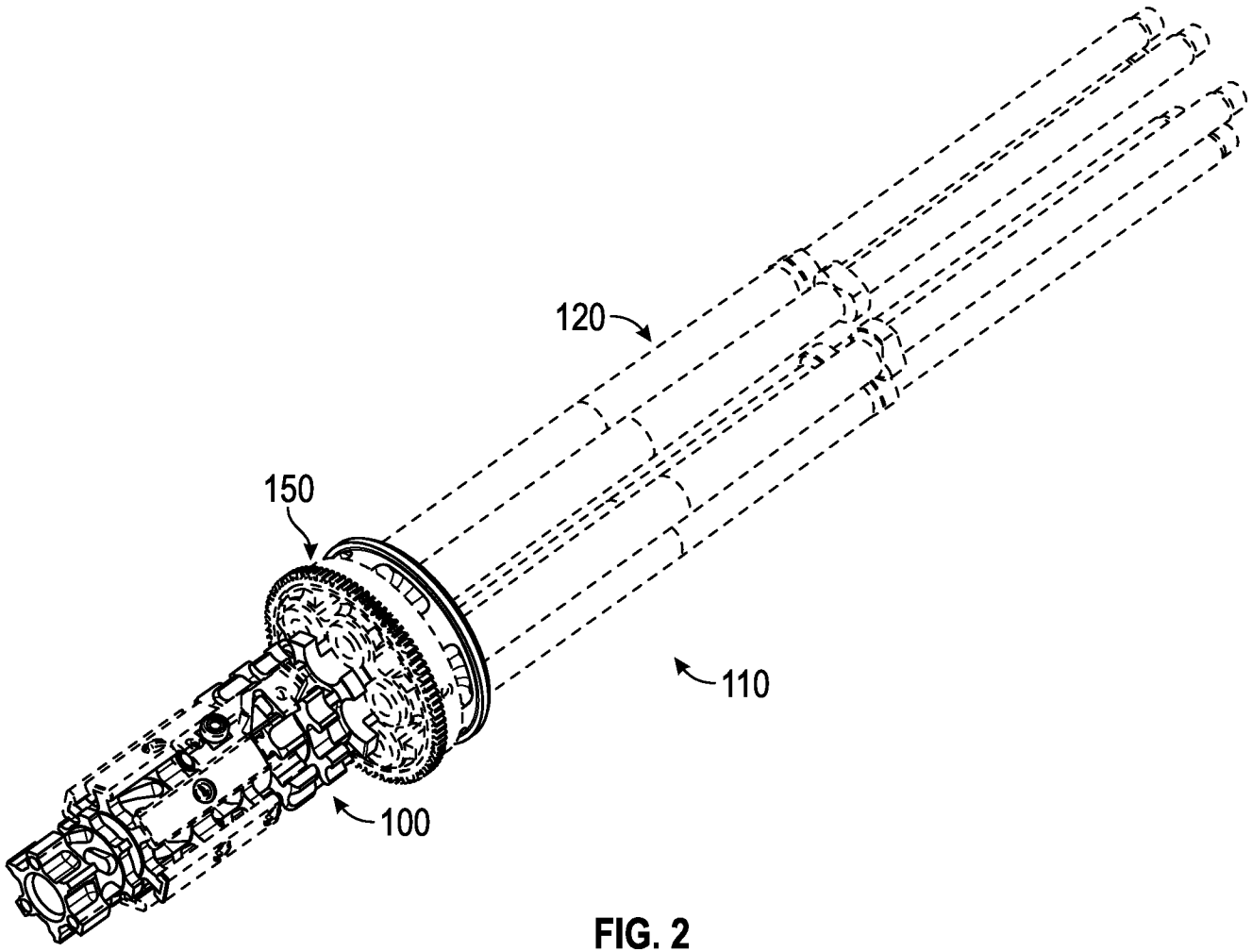
FIG. 2 is a rear perspective view of the portion of the M134 machine gun of FIG. 2.
Figure 3:
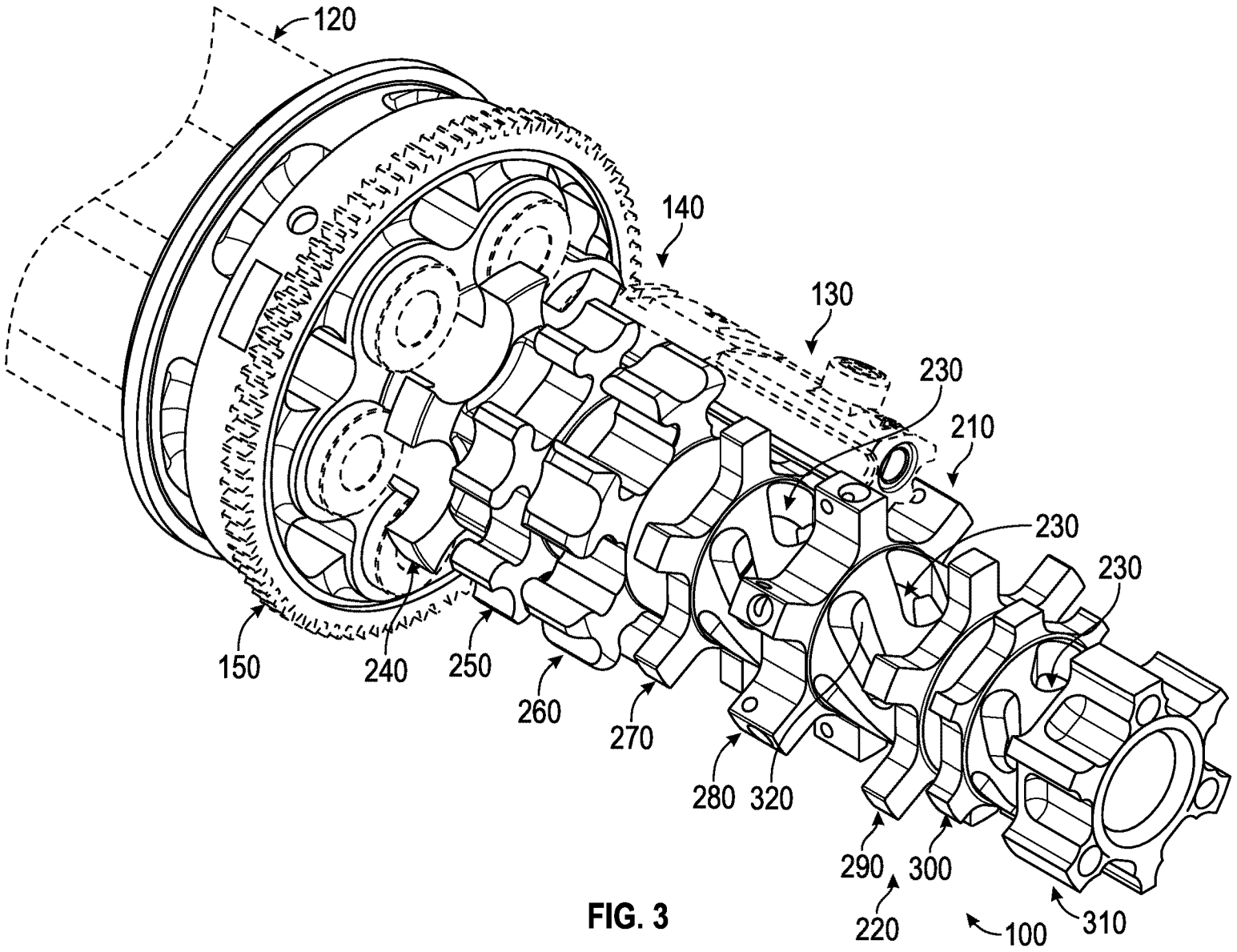
FIG. 3 is an enlarged rear perspective view of the cooling rotor of FIGS. 1 and 2.
Figure 5:
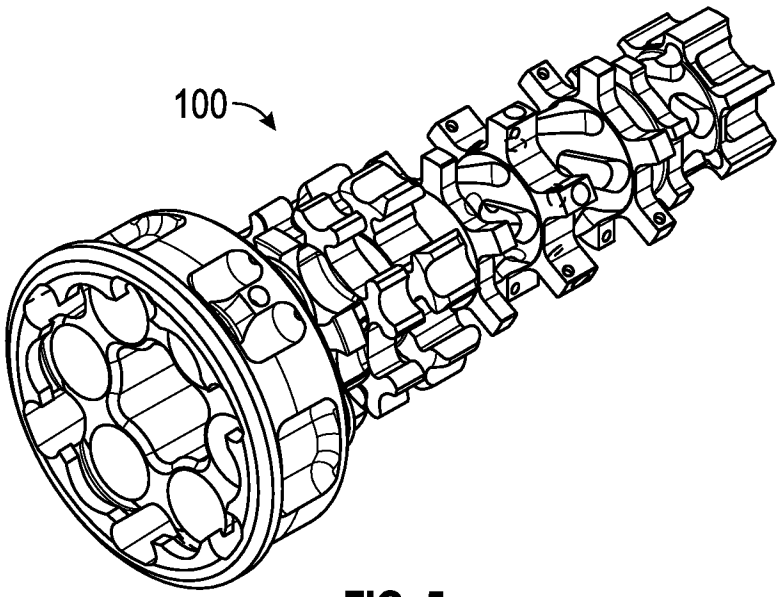
FIG. 5 is a front perspective view of the cooling rotor of FIGS. 1-4.
Figure 4:
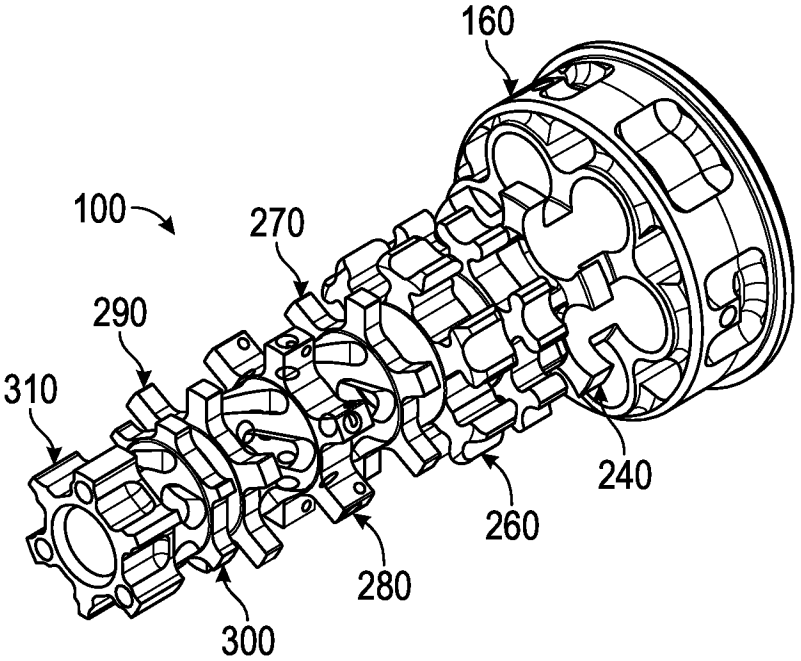
FIG. 4 is another rear perspective view of the cooling rotor of FIGS. 1-3.

With reference to FIGS. 1-6, an embodiment of a cooling rotor 100 for a M134 minigun firearm 110 and method of using the same will be described. The cooling rotor 100 actively pulls gases and heat generated from firing the minigun 110 thru passages in the rotor 100 and out a front of the rotor 100. By removing gases and debris in this manner, the rotor 100 creates a safer environment and minimizes the possibility of flashing unspent powder. The rotor 100 is made of Maraging 300/VASCOMAX® 300 (AMS 6514) steel, which is an 18% nickel, cobalt strengthened steel (C-type) with excellent properties, workability and heat treatment characteristics. The rotor 100 is a single-piece design, minimizing misalignment from separate pieces controlling the firing of the minigun 110.

The minigun 110 fires a cartridge that includes a bullet, a cylindrical cartridge case, a primer, and powder. When the cartridge is fired by first detonating the primer, which ignites the powder, pressure within the cartridge case increases to the point that the bullet is forced out of the cartridge case and down one of six barrels 120 of the minigun 110. The minigun 110 includes a main housing (not shown) that encloses and supports the rotor 100. The cartridges are handled by six bolt assemblies 130, each aligned with a respective one of the six barrels 120. The six bolt assemblies 130 are attached to and positioned circumferentially around the rotor 100. The rotor 100 comprises the core axis of the minigun 110. The six barrels 120 are connected to a forward portion 140 of the rotor 100 and are arranged for rotation as a cluster around the core axis of the minigun 110. As the rotor 100 rotates, the bolt assemblies 130 are driven forward and rearward by a helical cam incorporated within the main housing. The helical cam causes the cartridges to be delivered to the bolt assemblies 130, chambered in a barrel 120, and then fired. The empty cartridges are extracted from the chambers and ejected. The rotor 100 is rotated by means of a series of gears such as forward gear 150 driven by an electric motor. Removable track, which can also be considered an aft track, 155 is a continuation of forward track and center track. The removable track 155 is removable to allow the firing bolt to be installed and removed. The firing bolt rides between the sides of the forward, center, and removable tracks as the bolt moves forward and aft following the tracks. Gases, heat, and debris generated from firing the minigun 110 would normally be directed into the area between the rotor 100 and the main housing. The gases, heat, and debris would normally then be forced at high velocity through various openings in the housing, subjecting the operator to possible injury.

The cooling rotor 100 is configured to actively pull gases and heat generated from firing the minigun 110 thru passages in the rotor 100 and out a front of the rotor 100 to overcome the above problem that would normally occur. The rotor 100 includes a drive gear support 160 at a front end 165, which includes a front face 170, and a rear end 180 at an opposite end. A bore 190 extends through a center of the rotor 100 from the rear end 180 to an axial opening 200 of the front end 165. A periphery 210 of the rotor 100 includes a plurality of longitudinally spaced, peripherally extending rotor segments 220 with respective angled support structures 230 between the longitudinally spaced rotor segments 220. From front-to-rear, the longitudinally spaced rotor segments 220 include one or more of a rotation bolt guide 240, a forward track 250, a center track 260, a front removable track support 270, a center removable track support 280, a rear removable track support 290, a front drive sleeve 300, and a clutch assembly support 310. In a preferred embodiment, the angled support structures 230 extend between 1) the front removable track support 270 and the center removable track support 280, 2) the center removable track support 280 and the rear removable track support 290, and 3) the front drive sleeve 300 and the clutch assembly support 310. In an alternative embodiment, the angled support structures 230 extend between one or more of the rotation bolt guide 240, the forward track 250, the center track 260, the front removable track support 270, the center removable track support 280, the rear removable track support 290, the front drive sleeve 300, and/or the clutch assembly support 310. Each of the angled support structures 230 include circumferentially spaced angled openings 320 therein. Each of the angled support structures 230 (with openings 320) extend at one or more of the same or different angles α from 30 degrees to 80 degrees off of the front face 170.

Figure 6:
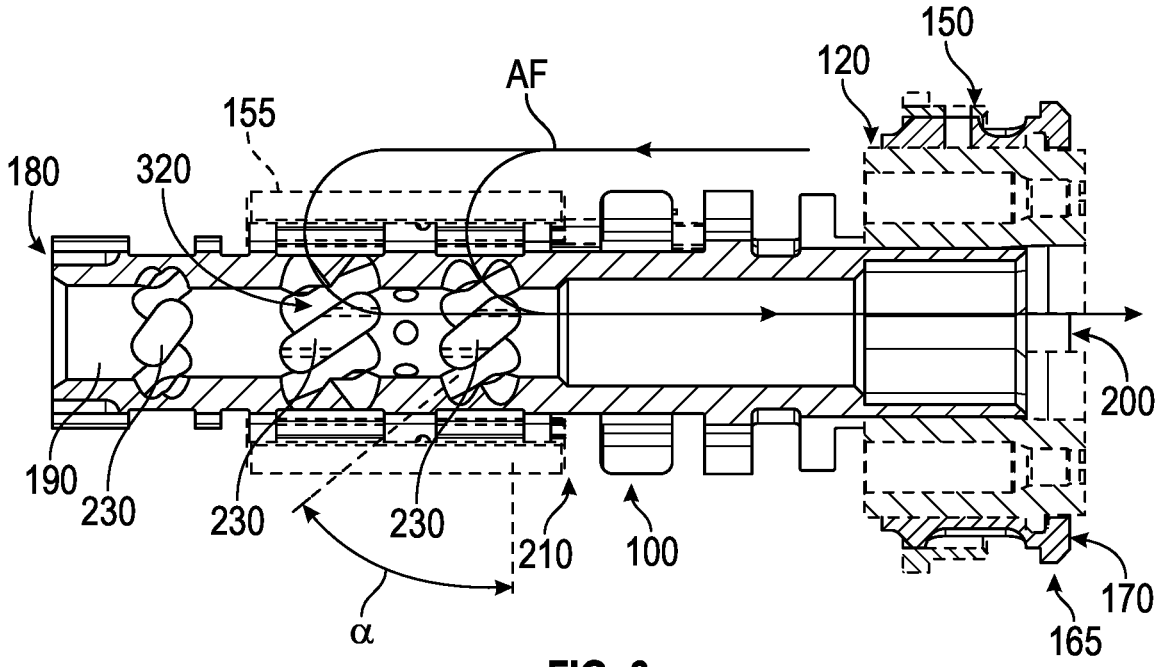
FIG. 6 is a cross-sectional view of the cooling rotor of FIGS. 1-5.

With reference to FIG. 6, as the cooling rotor 100 rotates during operation of the minigun 110, air flow AF is pulled through the rotor 100 as shown, between the longitudinally spaced rotor segments 220, directed by the angled support structures 230 through the openings 320, into the bore 190, and forward, out through the axial opening 200 and away from the operator. The spaces between the longitudinally spaced rotor segments 220, the openings 320, the bore 190, and the axial opening 200 form passages that the cooling rotor 100 actively pulls gases and heat generated from firing the minigun 110 thru. The air flow AF pulled through the rotor 100 and expelled out the front through the axial opening 200 includes the gases, heat, and shrapnel generated from firing the minigun 110. By removing gases and debris in this manner, the rotor 100 creates a safer environment and minimizes the possibility of flashing unspent powder. Because the rotor 100 is a single-piece design, misalignment causes from separate pieces controlling the firing of the minigun 110 is minimized.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A cooling rotor for a minigun, the cooling rotor actively pulling gases and heat generated from firing a minigun and comprising:

a. a front end with an axial opening;

b. a rear end;

c. a bore extending from the rear end to the axial opening in the front end;

d. a plurality of longitudinally spaced, peripherally extending rotor segments, some of which are configured to circumferentially receive a respective plurality of bolt assemblies thereon;

e. one or more openings disposed between two or more of the plurality of longitudinally spaced, peripherally extending rotor segments whereby upon rotation of the cooling rotor gases and heat generated from firing a minigun are actively pulled through the one or more openings, the bore, and out the axial opening in the front end.

2. The cooling rotor of claim 1, further including one or more angled support structures between at least two of the longitudinally spaced, peripherally extending rotor segments, the one or more angled support structures including the one or more openings.

3. The cooling rotor of claim 1, wherein the plurality of longitudinally spaced, peripherally extending rotor segments include two or more of a rotation bolt guide, a forward track, a center track, a front removable track support, a center removable track support, a rear removable track support, a front drive sleeve, and a clutch assembly support.

4. The cooling rotor of claim 3, further including one or more angled support structures are disposed between two or more of the rotation bolt guide, the forward track, the center track, the front removable track support, the center removable track support, the rear removable track support, the front drive sleeve, and the clutch assembly support, the one or more angled support structures including the one or more openings.

5. The cooling rotor of claim 4, wherein the one or more angled support structures are disposed between the front removable track support and the center removable track support.

6. The cooling rotor of claim 4, wherein the one or more angled support structures are disposed between the center removable track support and the rear removable track support.

7. The cooling rotor of claim 4, wherein the one or more angled support structures are disposed between the front drive sleeve and the clutch assembly support.

8. The cooling rotor of claim 4, wherein the one or more angled support structures are disposed between the front removable track support and the center removable track support, the center removable track support and the rear removable track support, and the front drive sleeve and the clutch assembly support.

9. The cooling rotor of claim 4, wherein the one or more angled support structures are disposed extend at one or more of the same or different angles $\alpha$ from 30 degrees to 80 degrees off of the front face.

10. The cooling rotor of claim 4, wherein the rotor has a single-piece construction made of 18% nickel, cobalt strengthened steel (C-type).

11. The rotor of claim 3, further including one or more angled support structures are disposed between two or more of the rotation bolt guide, the forward track, the center track, the front removable track support, the center removable track support, the rear removable track support, the front drive sleeve, and the clutch assembly support, the one or more angled support structures including the one or more openings.

12. The rotor of claim 11, wherein the one or more angled support structures are disposed between the front removable track support and the center removable track support.

13. The rotor of claim 11, wherein the one or more angled support structures are disposed between the center removable track support and the rear removable track support.

14. The rotor of claim 11, wherein the one or more angled support structures are disposed between the front drive sleeve and the clutch assembly support.

15. The rotor of claim 11, wherein the one or more angled support structures are disposed between the front removable track support and the center removable track support, the center removable track support and the rear removable track support, and the front drive sleeve and the clutch assembly support.

16. The rotor of claim 11, wherein the one or more angled support structures are disposed extend at one or more of the same or different angles α from 30 degrees to 80 degrees off of the front face.

17. A method of using the cooling rotor of claim of claim 1, comprising:

a. rotating the cooling rotor;

b. actively pulling gases and heat generated from firing the minigun through the one or more openings, the bore, and out the axial opening in the front end, away from an operator of the minigun.

18. The method of claim 17, wherein the cooling rotor includes one or more angled support structures between at least two of the longitudinally spaced, peripherally extending rotor segments, the one or more angled support structures including the one or more openings, and actively pulling includes using the one or more angled support structures to facilitate pulling the gases and heat generated from firing the minigun through the one or more openings.

19. The method of claim 17, wherein the plurality of longitudinally spaced, peripherally extending rotor segments include two or more of a rotation bolt guide, a forward track, a center track, a front removable track support, a center removable track support, a rear removable track support, a front drive sleeve, and a clutch assembly support, and actively pulling includes pulling the gases and heat generated from firing the minigun through the one or more openings between two or more of the rotation bolt guide, the forward track, the center track, the front removable track support, the center removable track support, the rear removable track support, and the front drive sleeve.

20. The method of claim 19, wherein the cooling rotor includes one or more angled support structures disposed between two or more of the rotation bolt guide, the forward track, the center track, the front removable track support, the center removable track support, the rear removable track support, the front drive sleeve, and the clutch assembly support, the one or more angled support structures including the one or more openings, and actively pulling includes using the one or more angled support structures to facilitate pulling the gases and heat generated from firing the minigun through the one or more openings.

21. The method of claim 20, wherein the one or more angled support structures are disposed between the front removable track support and the center removable track support, and actively pulling includes using the one or more angled support structures to facilitate pulling the gases and heat generated from firing the minigun through the one or more openings between the front removable track support and the center removable track support.

22. The method of claim 20, wherein the one or more angled support structures are disposed between the center removable track support and the rear removable track support, and actively pulling includes using the one or more angled support structures to facilitate pulling the gases and heat generated from firing the minigun through the one or more openings between the center removable track support and the rear removable track support.

23. The method of claim 20, wherein the one or more angled support structures are disposed between the front drive sleeve and the clutch assembly support, and actively pulling includes using the one or more angled support structures to facilitate pulling the gases and heat generated from firing the minigun through the one or more openings between the front drive sleeve and the clutch assembly support.

24. The method of claim 20, wherein the one or more angled support structures are disposed between the front removable track support and the center removable track support, the center removable track support and the rear removable track support, and the front drive sleeve and the clutch assembly support, and actively pulling includes using the one or more angled support structures to facilitate pulling the gases and heat generated from firing the minigun through the one or more openings between the front removable track support and the center removable track support, the center removable track support and the rear removable track support, and the front drive sleeve and the clutch assembly support.

25. The cooling rotor of claim 20, wherein the one or more angled support structures are disposed extend at one or more of the same or different angles α from 30 degrees to 80 degrees off of the front face.

26. A single-piece rotor for a minigun, comprising:

a. a front end with an axial opening;

b. a rear end;

c. a bore extending from the rear end to the axial opening in the front end;

d. a plurality of longitudinally spaced, peripherally extending rotor segments, some of which are configured to circumferentially receive a respective plurality of bolt assemblies thereon.

27. The rotor of claim 26, further including one or more openings disposed between two or more of the plurality of longitudinally spaced, peripherally extending rotor segments.

28. The rotor of claim 27, further including one or more angled support structures between at least two of the longitudinally spaced, peripherally extending rotor segments, the one or more angled support structures including the one or more openings.

29. The rotor of claim 26, wherein the plurality of longitudinally spaced, peripherally extending rotor segments include two or more of a rotation bolt guide, a forward track, a center track, a front removable track support, a center removable track support, a rear removable track support, a front drive sleeve, and a clutch assembly support.

30. The rotor of claim 26, wherein the rotor is made of 18% nickel, cobalt strengthened steel (C-type).

* * * * *